US008186085B2

(12) United States Patent
Garfinkle

(10) Patent No.: US 8,186,085 B2
(45) Date of Patent: May 29, 2012

(54) SIGNAGE WITH SELL BY FEATURE

(76) Inventor: Benjamin L. Garfinkle, Piedmont, CA (US)

( * ) Notice: Subject to any disclaimer, the term of this patent is extended or adjusted under 35 U.S.C. 154(b) by 13 days.

(21) Appl. No.: 12/019,546

(22) Filed: Jan. 24, 2008

(65) Prior Publication Data

US 2009/0188140 A1 Jul. 30, 2009

(51) Int. Cl.
*G09F 7/00* (2006.01)

(52) U.S. Cl. ..... 40/661.03; 40/661.08; 40/637

(58) Field of Classification Search ..... 40/115, 40/113, 495, 661.03, 661.08, 637
See application file for complete search history.

(56) References Cited

U.S. PATENT DOCUMENTS

| | | | | | |
|---|---|---|---|---|---|
| 291,349 | A | * | 1/1884 | Hyatt | 235/114 |
| 445,838 | A | * | 2/1891 | Larkin | 40/618 |
| 1,542,742 | A | * | 6/1925 | Stevenson | 40/115 |
| 1,848,262 | A | * | 3/1932 | Meyer | 40/652 |
| 2,006,485 | A | * | 7/1935 | Segal | 40/115 |
| 2,588,635 | A | * | 3/1952 | Junkin | 40/650 |
| 2,923,078 | A | * | 2/1960 | Slavsky | 40/661.03 |
| 3,973,514 | A | * | 8/1976 | Patrick | 116/315 |
| 4,088,533 | A | * | 5/1978 | McGuire | 376/310 |
| 4,151,668 | A | * | 5/1979 | Hungerford | 40/495 |
| 4,698,928 | A | * | 10/1987 | Soporowski | 40/651 |
| 4,972,757 | A | * | 11/1990 | Nissl et al. | 89/8 |
| 5,125,688 | A | * | 6/1992 | Bianco | 283/2 |
| D348,286 | S | * | 6/1994 | Garfinkle | D20/43 |
| 5,718,072 | A | * | 2/1998 | Garfinkle | 40/607.13 |
| D532,827 | S | * | 11/2006 | Garfinkle | D20/18 |
| D550,286 | S | * | 9/2007 | Garfinkle | D20/18 |

FOREIGN PATENT DOCUMENTS

WO WO 9009016 A * 8/1990

* cited by examiner

*Primary Examiner* — Casandra Davis
(74) *Attorney, Agent, or Firm* — Bay Area Technology Law Group PC

(57) ABSTRACT

A sign for the display of perishable goods in a display case. The sign includes a front face and rear face, the front face being visible to a consumer when in use providing information to the consumer regarding the perishable goods. The rear face has at least one rotating dial, individual or folded panel for selection of at least one date on which the perishable goods would be removed from the display case.

3 Claims, 4 Drawing Sheets

SIGNAGE WITH SELL BY FEATURE

TECHNICAL FIELD

The present invention involves a sign particularly useful in the sale of perishable goods in a display case. The sign includes a feature of value to the retailer. Specifically, at least one "sell by" date is selectable on the rear face of the sign in order to provide pull date information to the retailer either for the entire display case, per se, or in segments of the display case. The latter feature is important in instances where certain portions of the case contain perishable goods which should be removed or rotated if not sold by specific dates.

BACKGROUND OF THE INVENTION

Retailers, such as supermarket operators, routinely sell hundreds if not thousands of items, many of which are quite perishable. Some retailers rotate stock so that the more recently received additions to a display case are positioned behind older products which are to be sold sooner. Not only is it important to inventory and track the age of perishable goods to maintain freshness and customer appeal but, oftentimes, date tracking must be carried out to ensure that products which may have deteriorated to the point of spoilage have been removed.

Although no retailer looks forward to removing perishable goods from a display case thus adding to the "shrinkage" burden imposed upon the cost of goods, the alternative of selling products which have spoiled is a considerably less desirable alternative. Not only is the sale of spoiled goods harmful to a retailer's reputation, but such sales could result in compromising a customer's health and resultant liability.

It is thus important that a retailer track the age of perishable goods to ensure freshness and wholesomeness. Products such as fish are particularly susceptible to deterioration and when such products are tray packed, it is oftentimes difficult to determine freshness or wholesomeness merely by visual inspection.

Tracking procedures to create "sell by" dates have, in the past, ranged from the counter manager simply keeping track of such matters in his or her mind to formal recordkeeping in a log. The informal approach to such matters may work effectively in a low volume environment where a single clerk manages the display and sales of perishable products. However, in a large retail environment where there are multiple shifts and constant employee turnover, a more structured approach is necessary. This is particularly true in the display of products which are segmented or tiered where "sell by" dates may differ from segment to segment.

In this regard, reference is made to FIG. 1 where display case 10 is depicted. Display case 10 can be, for example, a refrigerated case displaying perishable products on top portion 11 and bottom portion 12 oftentimes segregated by a paper or similar separator 14. Because top portion 11 would be more prominent to a shopper, products which the retailer wishes to sell more quickly due to product's age may be displayed there while more recent arrivals, thus having a more extended shelf life, would be placed on bottom portion 12. A single sign 13 providing the consumer with product identifying information and cost is positioned as indicated. If a retailer was to create a "sell by" date for product contained within refrigerated case 10, a first date would, by necessity, be established for goods displayed in top portion 11 while a second, more extended date, established for the goods located on bottom portion 12. This obviously complicates the pull dates for the various products contained within refrigerated case 10.

In addition to tracking pull or "sell by" dates, a retailer may also wish to be reminded when products from different segments of a case should be rotated. For example, a retailer may wish to rotate the products on top portion 11 to bottom portion 12 while placing the products on bottom portion 12 onto top portion 11 or to a completely different location. Such considerations may be dictated by product freshness among other concerns.

It is thus an object of the present invention to provide signage which is capable of readily reminding a retailer when products should be rotated or pulled from a shelf, particularly as involving perishable goods.

These and other objects will be more readily apparent when considering the following disclosure and appended claims.

SUMMARY OF THE INVENTION

The present invention is directed to a sign for the display of perishable goods in a display case comprising a front face and a rear face, the front face being visible to the consumer when in use providing information to the consumer regarding the perishable goods. As a first embodiment, the rear face is provided with at least one rotary dial for selection of at least one date when the perishable goods are to be removed from the display case. Two or more rotary dials are employed when different dates are to be established for pulling perishable goods from multiple locations within a display case or rotating such goods within the display case, as needed. As a second embodiment, "sell by" or "pull" dates can be established by preprinted individual or folded panels inserted to tracks also on the rear face of appropriate signage.

DETAILED DESCRIPTION OF THE INVENTION

Figure 2A:
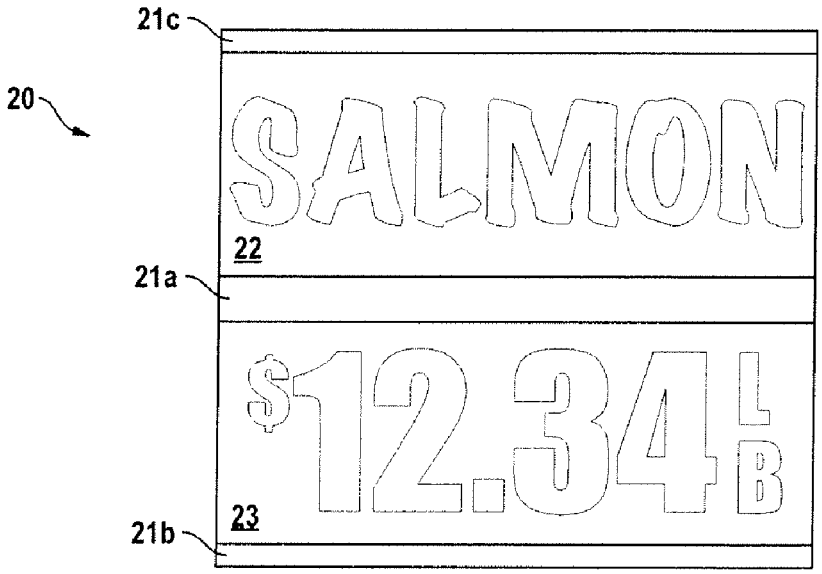
FIG. 2A is a plan view of a front face of a typical sign that would benefit from the practice of the present invention.
Figure 2B:
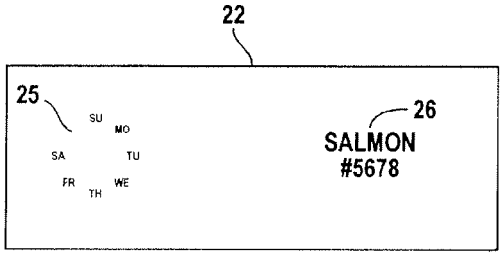
FIG. 2B is an insert for the sign of FIG. 2A constituting an element of the present invention.
Figure 2C:
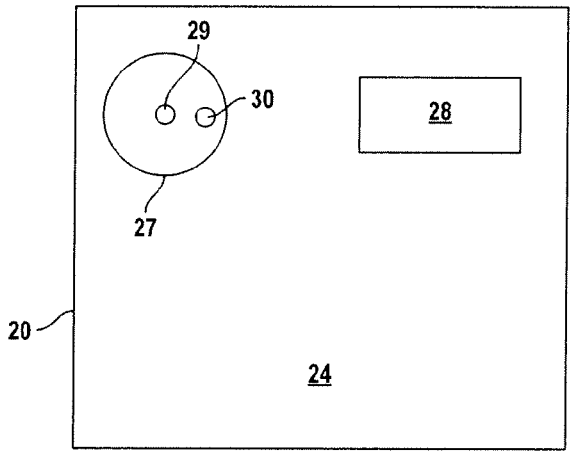
FIG. 2C is a plan view of the back side of the sign of FIG. 2A for receipt of the insert of FIG. 2B.

To gain a further appreciation of the first embodiment of the present invention, reference is first made to FIGS. 2A-2C.

Figure 1:
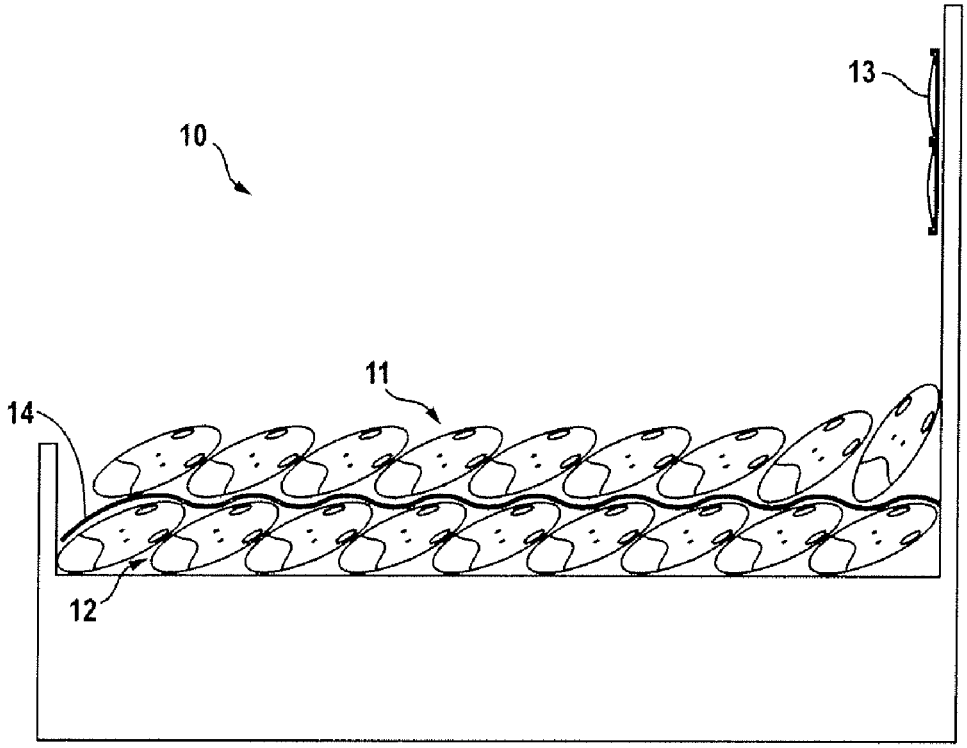
FIG. 1 is a side view of a typical segmented display case that would benefit from the use of the present invention.
Figure 6:
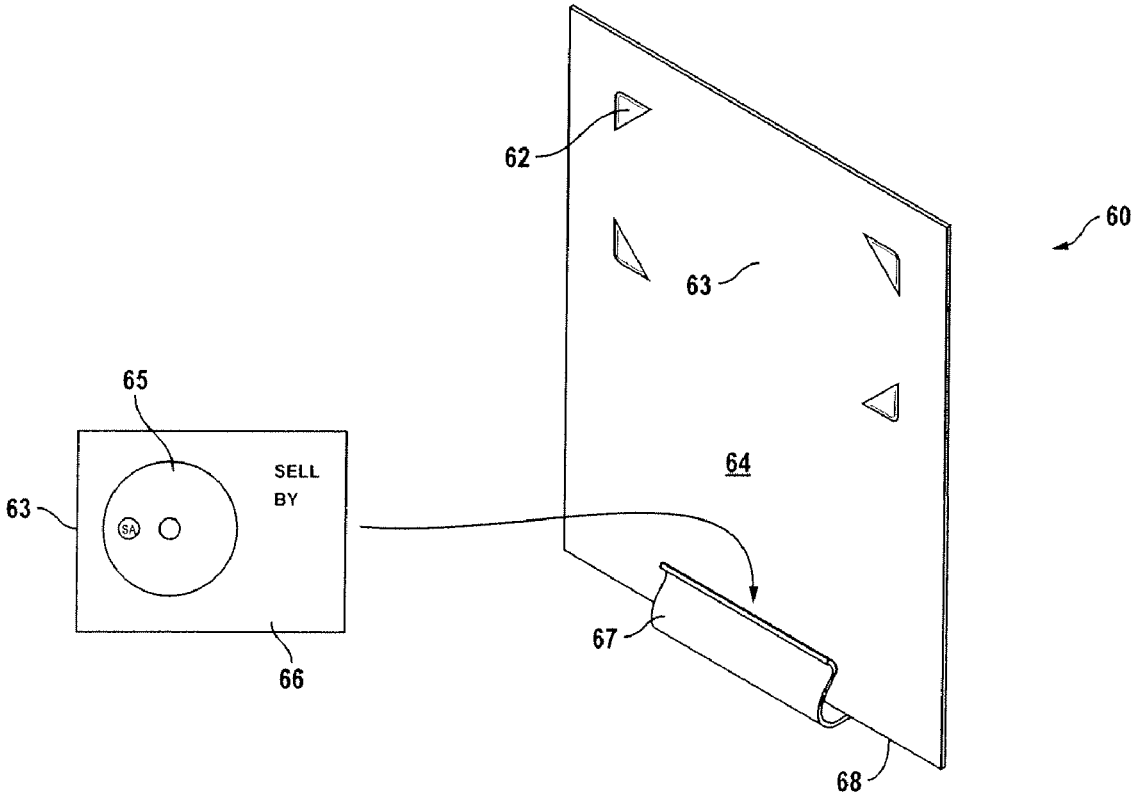
FIG. 6 is a plan view of the back side of a further embodiment of the present invention showing the incorporation of a "sell by" element on the back side of a typical sign useful in practicing the present invention.

In this regard, sign 20 represents a display typically found in a case such as that shown in FIG. 1. In this regard, lips 21A, 21B and 21C are established to create horizontally extending top and bottom channels. In this example, top and bottom channels receive horizontally changeable plastic inserts noting that salmon is being sold at $12.34 per lb. It is this front face of sign 20 that would typically be seen by a consumer standing before case 10. It should be appreciated, however, that the present invention can be used with other forms of typical retail signage. For example, instead of channels, the product identifying information could be held in place by corner tabs, such as shown as elements 62 of FIG. 6 or signage could be preprinted on its front side (not shown).

On the back side of sign 20 is optional open window 28 such that when sign 22 is slipped within the channel established by lips 21A and 21C (FIG. 2A), the product being sold, namely, salmon, and its sku number printed on the back side of sign 22 in field 26 would appear through open window 28 to enable a counter clerk to readily see the product being sold without having to turn signage 20 to read its front face. Sign 22 also is printed on its back side with abbreviations of each day of the week as well as, optionally, a blank or unprinted segment in field 25. As signage 22 slips between lips 21A and 21C, field 25 would be positioned behind rotating dial 27.

Rotating dial 27 is configured to freely rotate about axis 29 such that open window 30 would be positioned within field 25 to reveal a selected day of the week that would inform counter staff when perishable goods, such as salmon in this instance, would have to be sold to ensure appropriate freshness.

In use, once a display of perishable goods is first laid out, generally in a refrigerated case, counter staff would select an appropriate sign from a bin of signs 20 and insert at appropriate channels or corner tabs, the product identifying signage 22 and price signage 23. Recognizing the window of opportunity to sell the product before it ages and no longer can be sold, counter staff would then rotate dial 27 until an appropriate day of the week is displayed through window 30. Use of this invention eliminates the need to separately track "sell by" dates by independent logs and the like. The invention is quite useful, particularly in high volume retail environments, where multiple counter staff employees work varying shifts and perishable goods are constantly being received and sold.

Figure 3A:
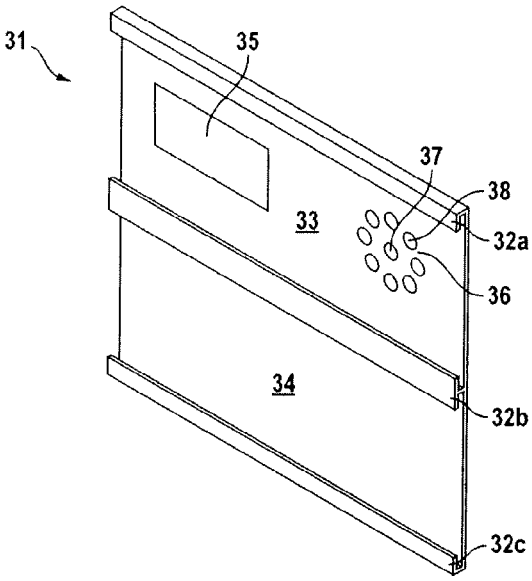
FIG. 3A is a perspective view of the embodiment of the sign depicted in FIGS. 2A-2C.

FIG. 3A depicts a sign similar to that illustrated in FIGS. 2A-2C. In this instance, the front side of sign 31 is shown having raised lips 32A, 32B and 32C establishing upper channel 33 and lower channel 34. Once again, these channels are sized and arranged to slidably receive typical product and pricing signage such as elements 22 and 23 of FIG. 2A. Product identifying information is optionally printed on the back side of such signage to appear through optional window 35 and thus visible on the back side of sign 31 for use by a counter clerk. Pricing signage would be received by channel 34. Sign 31, within channel 33 is configured with a center opening 37 and holes 38 within field 36. Center of opening 37 is intended to be attached to hole 41 of dial 40 with a fastener to enable dial 40 to rotate. Optional bump 39 is intended to align with holes 38 to enable dial 40 to "click" between positions to assist in aligning a different weekday abbreviation through opening 42.

Figure 3B:
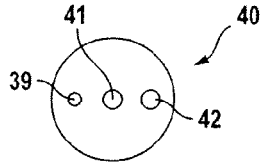
FIG. 3B is a plan view of an embodiment of the rotating dial element of the present invention for use herein.
Figure 4A:
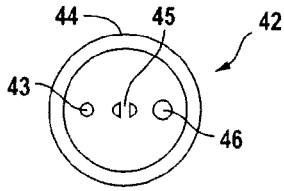
FIGS. 4A and 4B are plan and side views, respectively, of an embodiment of the rotating dial element of the presentation invention.
Figure 4B:
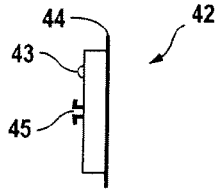

FIGS. 4A and 4B illustrate a typical rotating dial embodiment for use herein. Specifically, rotating dial 42 is shown having optional raised bump 43 corresponding to optional raised bump 39 of FIG. 3B. Rotating dial 42 includes raised lip 44 to facilitate rotation of dial 42 by counter staff. Molded barbs 45 are provided to click within a corresponding receiving channel such as element 37 of FIG. 3A. In use, barbs 45 compress towards one another as rotating dial 42 is pressed against the back side of sign 31. Upon proper seating, barbs 45 reassume their normal, unstressed, spacing enabling rotating dial 42 to so rotate enabling an appropriate day of the week abbreviation to appear through viewing hole 46.

Figure 5:
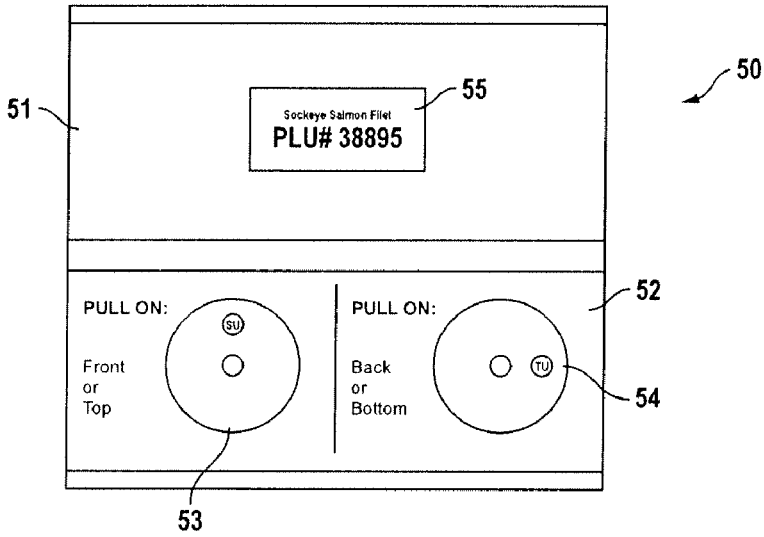
FIG. 5 is a plan view of the back side of a sign depicting a preferred embodiment of the present invention.

As a further embodiment of the present invention, reference is made to FIG. 5. To the consumer, sign 50 would appear to be identical to, for example, sign 20 (FIG. 2A) noting that product identification, when in place, could be printed on its reverse side to provide the display case operator with product information through window 55. However, in an environment such as shown in FIG. 1 where perishable products are displayed on upper and lower levels or regions of display case 10, signage 13 in the form of sign 50 can "fine tune" product management to ensure that the appropriate "sell by" dates are observed. For example, older products requiring an earlier pull date could be located on top portion 11 and its "sell by" date established by rotating dial 53 indicating that the product must be sold by Sunday or pulled from the shelf. Product located on bottom portion 12 located more remotely from a purchaser may be product which was received more recently and its pull or "sell by" date established by rotating dial 54 indicating that action must be taken by Tuesday. Both dials 53 and 54 can be retained within the same channel 52 as shown in FIG. 5.

Another use for the embodiment of FIG. 5 seen in conjunction with FIG. 1 is that upon a certain date, perishable product located on top portion 11 should be removed from the shelf while perishable product located on bottom portion 12 moved into a top location encouraging its purchase once product 11 has been removed. Fresh products would then be optionally placed within case 10 on shelf 12 as the rotation cycle continues.

It is interesting to note that the present invention can be employed in conjunction with pre-existing signs thus obviating the need to prepare an entirely new inventory of signs in mass. Such signage can include those with panels, corner tabs as well as signs which have been preprinted with product identifying information and price. For example, reference is made to FIG. 6 where the back side of sign 60 is shown. Such signs typically contain corner tabs 62 or channels such as depicted in previous embodiments creating a field on the front side of the sign opposite to field 63 where product identifying information or price would be made visible to a consumer. On the back side of sign 60 in field 64, module 63 can be appended. Double stick tape, glue, Velcro® or similar means can be provided whereby backing member 66 including wheel 65 operating as previously discussed is attached to region 64 to establish a "sell by" or "pull" date in conjunction with perishable product being displayed. When no "pull" or "sell by" date is necessary, for example, because a nonperishable product is being sold, module 63 could be removed or wheel 65 turned until its window aligns with a blank (non-date) space. Sign 60 can also be preprinted with product and price information on its front face noting that the same "sell by" feature as depicted by module 63 can be employed thereby. In such instances, obviously, the need for corner tabs 62 would be obviated.

Once again referring to FIG. 6, it is also proposed that instead of employing double stick tape, glue or Velcro® as suggested above to maintain module 63 in field 64, that removable clip 67 can be installed to lower edge 68 of sign 60 to removably secure module 63 thereto. Thus, virtually any sign 60 can be modified to employ the present invention on a case by case basis when needed.

Figure 7A:
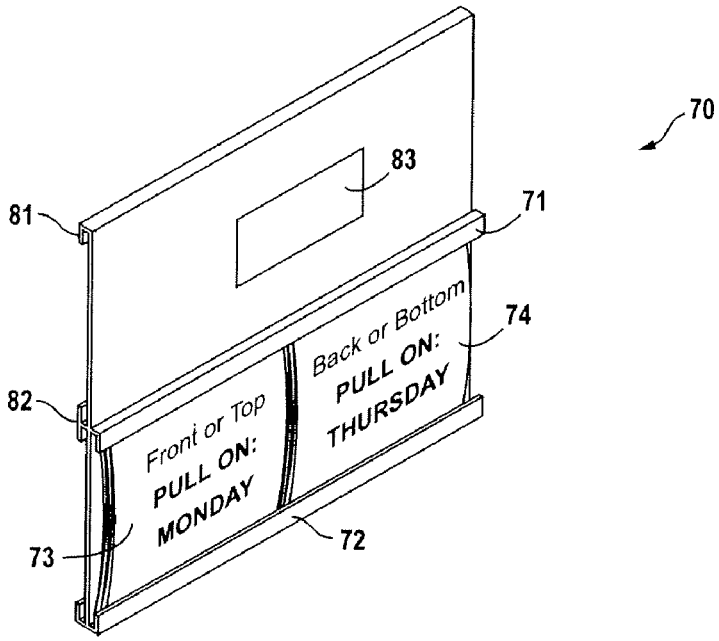
FIGS. 7A and 7B depict, in perspective, another embodiment of the present invention employing preprinted folded panels in place of the rotary dial embodiments depicted in the previous figures.
Figure 7B:
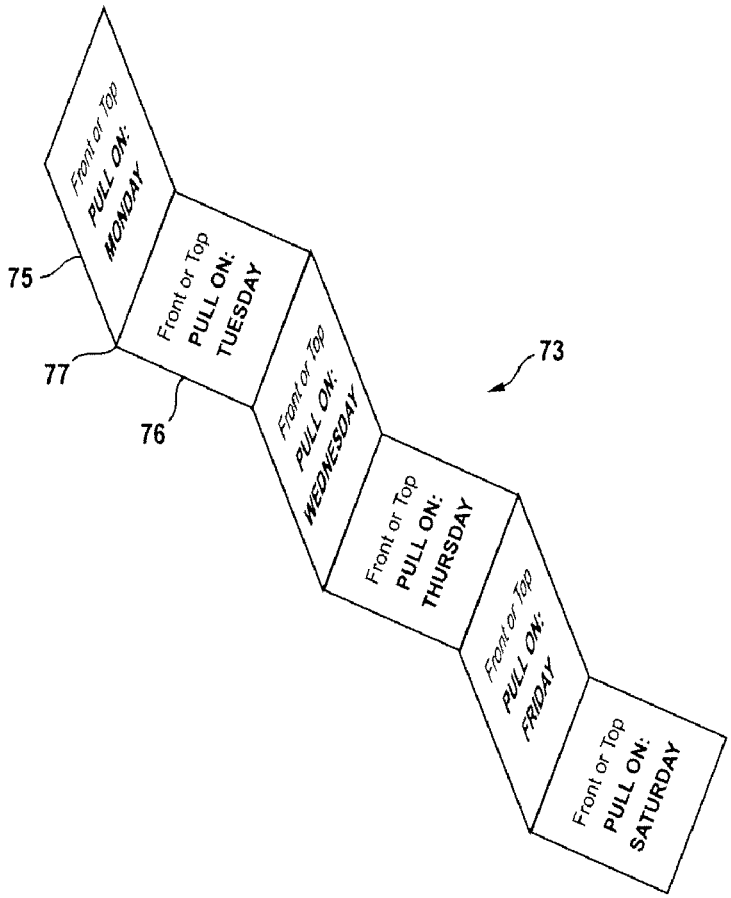

Reference is now made to FIG. 7 depicting yet another embodiment of the present invention. Specifically, sign 70 is shown having raised lips 71 and 72 similar to elements 32B and 32C of FIG. 3A. Product identifying information is optionally printed on the back side of signage placed into tracks 81 and 82 on the front face of sign 70 to identify products through window 83 again, in a similar fashion to what would appear through window 35 of FIG. 3A. However, instead of employing rotary dials to establish "sell by" or "pull" dates through the use of rotary dials, one or more folded panels 73/74 can be employed. Specifically, as noted by reference to FIG. 7B, panel 73 can be preprinted with days of the week and other indicia such as "front or top" or "back or bottom" printed on one or both sides thereof and when individual panels 75, 76, etc., are folded along fold lines 77, the appropriate panel could be made to removably reside in the channel defined by lips 71 and 72. Thus, instead of rotating dials as in previous embodiments, once perishable goods have been placed in a display case, the counter worker would simply fold panels 73 and 74 and insert them to identify the appropriate "sell by" or "pull" dates.

As a variation of the use of folded panels 73/74, single inserts akin to individual panels 75, 76, etc. could be preprinted with "sell by" or "pull" date information and merely slid into channels defined by lips 71 and 72.

It is to be understood that while certain forms of the present invention have been illustrated and described herein, it is not to be limited to the specific forms or arrangements of parts described and shown.

What is claimed is:

1. In combination, a display case containing perishable goods and a sign for providing information to consumers regarding said perishable goods, said sign comprising a front face and rear face, said front face being visible to a consumer from the front of the display case when in use providing information to the consumer regarding said perishable goods and said rear face visible from the rear of the display case having at least one rotary dial for selection of at least one date on which said perishable goods would be removed from said display case or rotated within the display case and wherein said rotary dial is provided with an opening and behind said rotary dial is printed the days of the week such that rotation of said rotary dial will selectively reveal a day of the week through said opening.

2. In combination, a display case containing perishable goods and a sign for providing information to consumers regarding said perishable goods, said sign comprising a front face and rear face, said front face being visible to a consumer from the front of the display case when in use providing information to the consumer regarding said perishable goods and said rear face visible from the rear of the display case having at least one rotary dial for selection of at least one date on which said perishable goods would be removed from said display case or rotated within said display case, said rear face being provided with two rotary dials for selection of two dates for the removal or rotation of said perishable goods from two distinct sections of said display case and wherein said rotary dials are each provided with an opening and behind each of said rotary dial is primed the days of the week such that rotation of each rotary dial will selectively reveal a day of the week through each of said openings.

3. In combination a display case containing perishable goods located within two distinct zones of said display case, and a sign for providing information to consumers regarding said perishable goods, said sign having a front face and a rear face, said front face being visible to a consumer from the front of the display case and having information regarding the goods located within said display case and said rear face visible from the rear of the display case having two rotary dials for selection of two dates for individually and selectively indicating when goods from each distinct zone are to be removed from said display case or rotated within said display case, said rotary dials each provided with an opening and behind each of said rotary dial is printed the days of the week such that rotation of each rotary dial will selectively reveal a day of the week through each of said openings.

* * * * *